US005514394A

United States Patent [19]

Lenahan

[11] Patent Number: 5,514,394

[45] Date of Patent: May 7, 1996

[54] CEREAL PACKAGE

[76] Inventor: Robert F. Lenahan, 3402 River Rd., Point Pleasant, N.J. 08742

[21] Appl. No.: 282,545

[22] Filed: Jul. 29, 1994

[51] Int. Cl.[6] ..... B65D 85/00

[52] U.S. Cl. ..... 426/120; 426/112; 426/115; 426/124; 426/130; 206/219

[58] Field of Search ..... 426/120, 115, 426/112, 130, 124; 206/219, 221, 222

[56] References Cited

U.S. PATENT DOCUMENTS

| | | | |
|---|---|---|---|
| 4,221,291 | 9/1980 | Hunt | 206/222 |
| 4,233,325 | 11/1980 | Slangan et al. | 426/120 |
| 4,247,001 | 1/1981 | Wiegner | 206/222 |
| 4,634,003 | 1/1987 | Ueda et al. | 426/120 |
| 4,875,576 | 10/1989 | Torgrimson et al. | 206/219 |
| 4,927,012 | 5/1990 | Rowe | 206/219 |
| 4,996,823 | 3/1991 | Byrne | 53/410 |
| 5,027,980 | 7/1991 | Bell | 222/94 |
| 5,071,034 | 12/1991 | Corbiere | 222/80 |
| 5,167,973 | 12/1992 | Snyder | 426/115 |
| 5,209,348 | 5/1993 | Schafer, III | 206/222 |
| 5,287,961 | 2/1994 | Herran | 206/219 |

FOREIGN PATENT DOCUMENTS 2670750 12/1990 France .

*Primary Examiner*—Donald E. Czaja
*Assistant Examiner*—Lien Tran
*Attorney, Agent, or Firm*—Nies, Kurz, Bergert & Tamburro

[57] ABSTRACT

A packaging assembly allows two substances, such as cereal and milk, to be held in separate compartments and then mixed when desired by applying hand pressure to the packaging assembly. The packaging assembly is provided with a compressible side wall portion and an impervious membrane having a frangible portion. The membrane separates the compartments such that applied pressure on the top of the package compresses the side wall portion and the downward pressure of the substance in the upper compartment causes the frangible portion of the membrane to rupture and thus allow the two substances to mix together. A partial wall may also be employed adjacent to the membrane to prevent regurgitation of the cereal and milk back into the upper compartment upon mixture in the lower compartment. The lower compartment may be opened to allow consumption directly from the package.

3 Claims, 6 Drawing Sheets

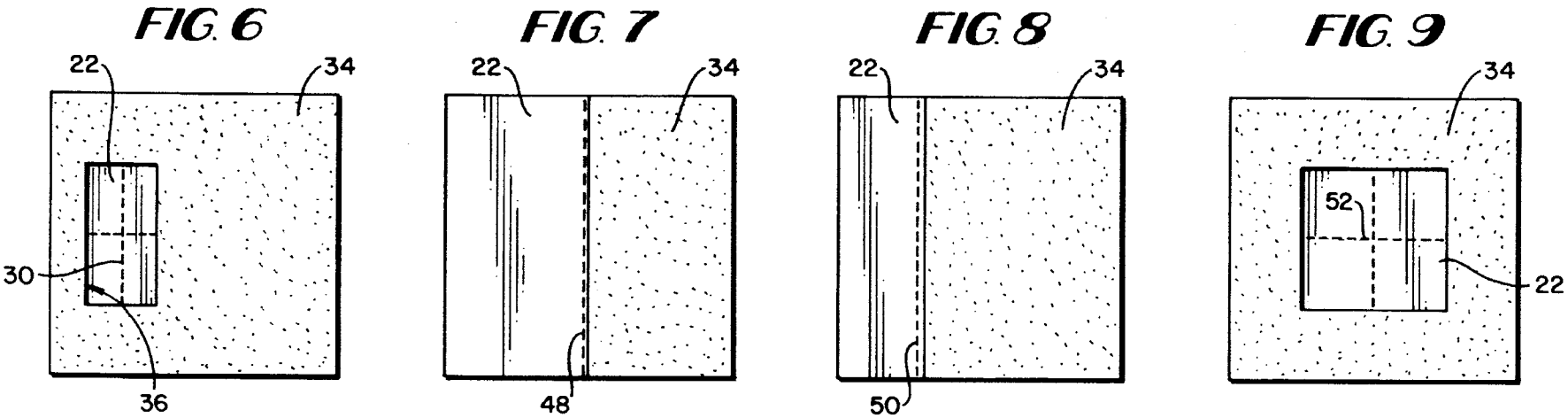
FIG. 6
34
22
36
30
FIG. 7
34
22
48
FIG. 8
34
22
50
FIG. 9
34
22
52
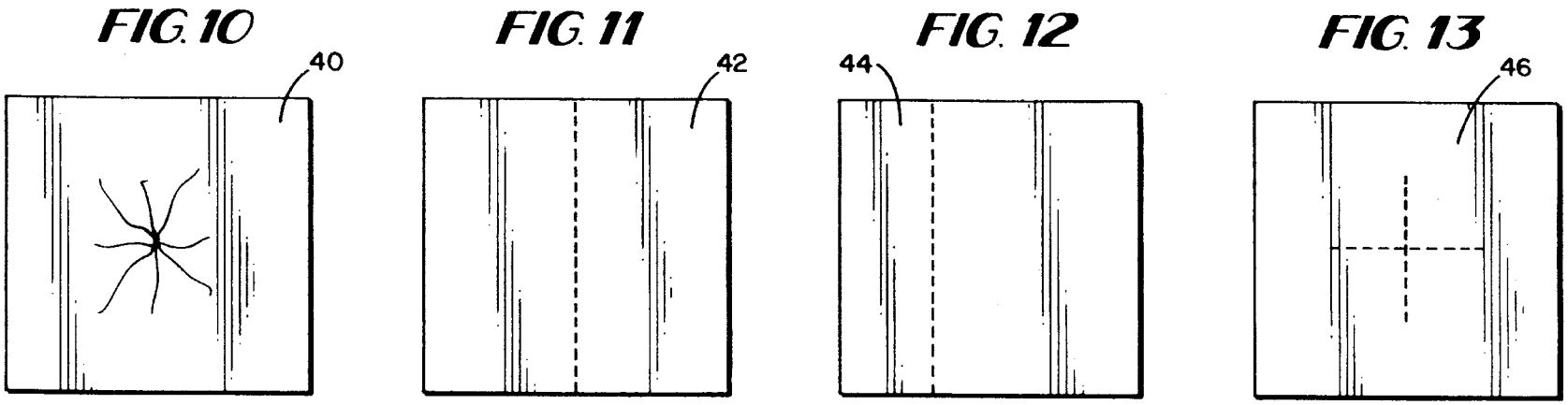
FIG. 10
40
FIG. 11
42
FIG. 12
44
FIG. 13
46

CEREAL PACKAGE

BACKGROUND OF THE INVENTION

1. Field of the Invention

This invention relates to packaging and more particularly to a packaging apparatus for separately holding two materials or substances such as cereal and milk in separate compartments within the same package whereupon, when the user desires, the cereal and milk may be mixed and the packaging apparatus may be used as a bowl.

2. Description of Related Art

Breakfast cereal has traditionally been packaged in its own individual box or package without the need for refrigeration in order to store it. However, a bowl and refrigerated milk are also needed in order to properly consume the cereal.

Some cereal packages now come with perforated panels which allow the cereal package to be used as a bowl as well as a cereal container. Also, with the development of UHT field containers, milk may now be stored unrefrigerated for long periods of time. These capabilities allow for cereal and milk to be stored together for long periods of time in the same container without spoiling.

In U.S. Pat. No. 5,167,973 to Snyder there is described a milk carton within a kit which may be punctured by the tip of a spoon and thereby release stored milk into a separate cereal compartment within the same kit. Another container is described in U.S. Pat. No. 5,209,348 to Schafer, wherein a valve controllably releases milk from one compartment of a containment bowl into the cereal compartment. Other packaging containers are described, for example, in the following U.S. Pat. Nos.: 4,927,012 to Rowe; 4,996,823 to Byrne; 5,027,980 to Bell; 5,071,034 to Corbiere; and 5,287,961 to Herran.

SUMMARY OF THE INVENTION

By the present invention, there is provided an improved unitary container having separate compartments which may be used to store two materials such as milk and cereal. The container is provided with a mid-portion having compressible side walls and a frangible membrane member which separates the compartments and allows the contents of each to be mixed by applying simple hand pressure. The container may then be opened to act as a cereal bowl out of which the cereal and milk may be consumed.

It is thus one object of the present invention to provide a practical, unitary, self-contained cereal and milk package capable of unrefrigerated storage.

It is another object of the invention to provide a unitary cereal and milk container which allows the cereal and milk to be combined by applying simple hand pressure.

It is another object of the invention to provide for the consumption of cereal and milk from the same package.

BRIEF DESCRIPTION OF THE DRAWINGS

FIG. 6 is a cross-sectional view taken along the line 6—6 of FIG. 3, showing the membrane of the present invention having an offset cross-seam rupture area with a partial wall supporting the surrounding portion of the membrane.

FIGS. 7 through 14 are alternative embodiments of the cross-section of the present invention shown in FIG. 6. Of these, FIGS. 10 through 13 present the frangible membrane absent any partial wall support.

DESCRIPTION OF THE PREFERRED EMBODIMENTS

Figure 2:
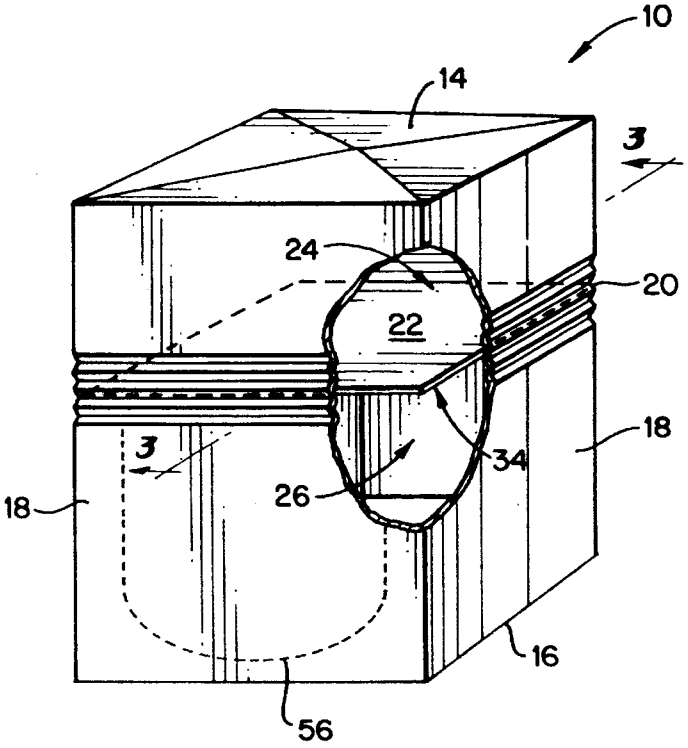
FIG. 2 is a perspective view of the cereal package of FIG. 1 with a corner cut away to show the interior of the package.
Figure 1:
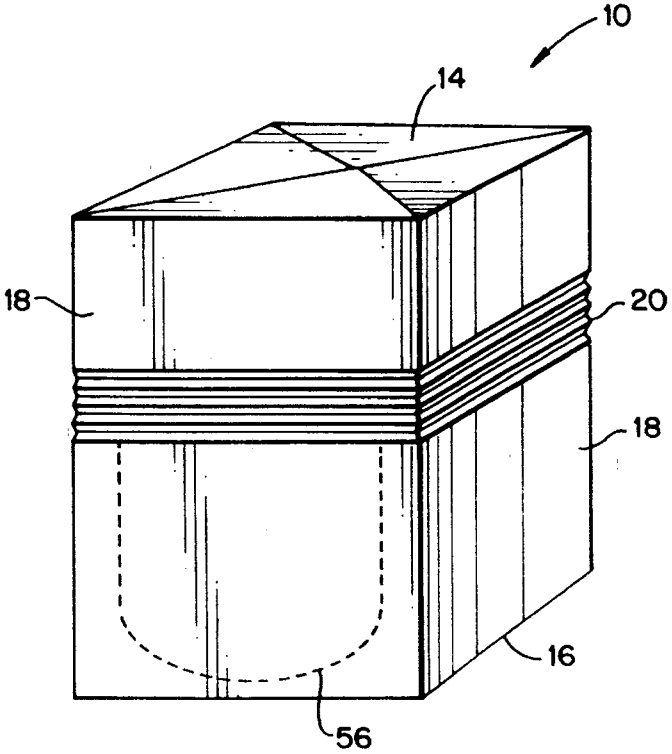
FIG. 1 is a perspective view showing the cereal package of the present invention.

In FIGS. 1 and 2, there is shown a cereal package 10 of the present invention in the form of a hollow, box shaped member having top 14, bottom 16, and side wall 18 members. Side wall members 18 are provided with a corrugated rib portion 20 which is capable of being compressed or collapsed together when pressure such as hand pressure is applied to top member 14 to compress the cereal package 10 downwardly.

Figure 4:
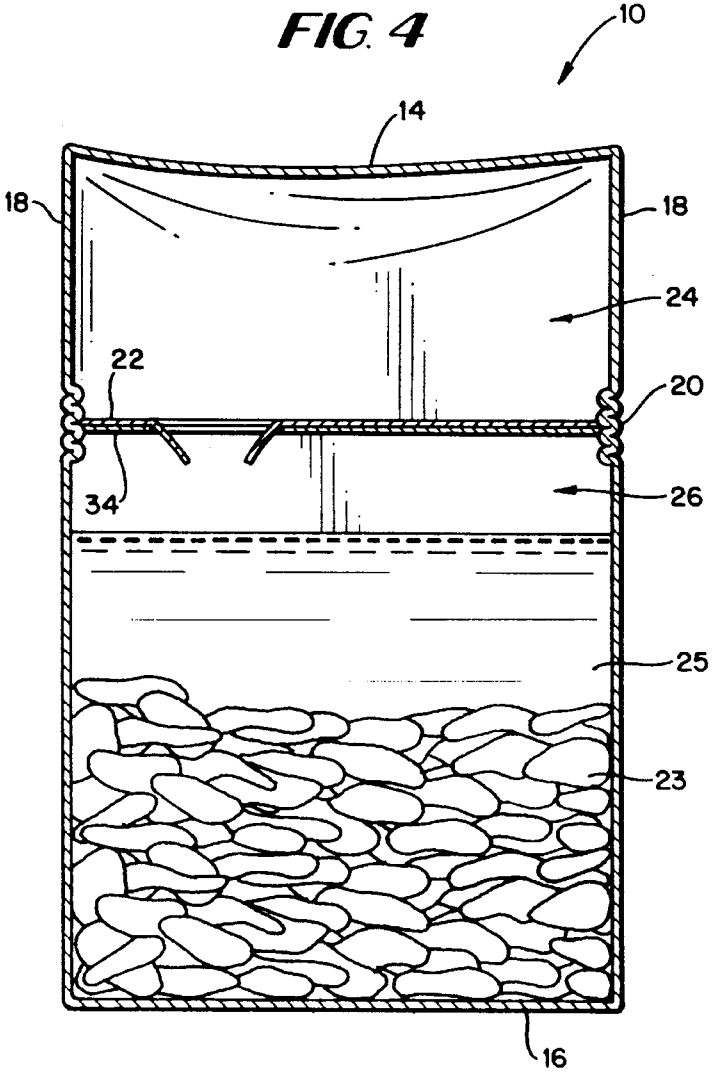
FIG. 4 is a side view of the cereal package of FIG. 1 after rupture of the membrane with the cereal and milk intermixed in the lower compartment.
Figure 3:
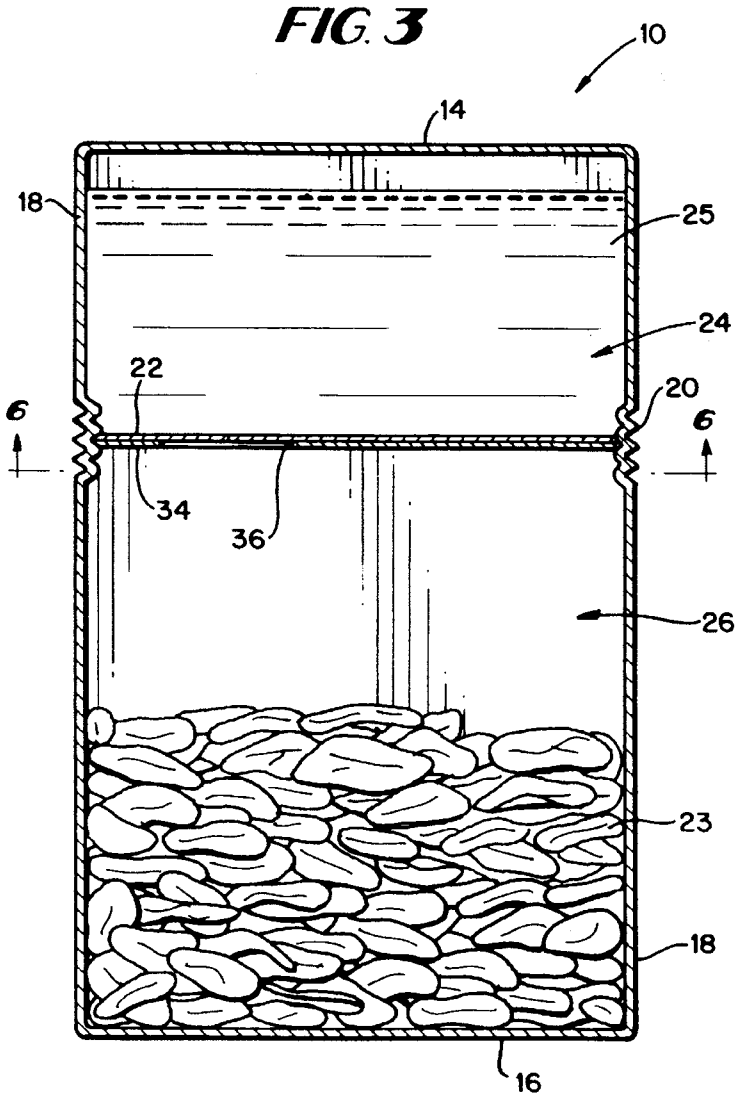
FIG. 3 is a side view of the cereal package of FIG. 1 before rupture of the membrane showing milk in the upper compartment and cereal in the lower compartment.

As shown in FIGS. 2 through 4, an impervious membrane 22, which may be of a suitable material such as plastic, foil or wax paper, separates the interior of cereal package 10 into an upper compartment 24 and a lower compartment 26. Membrane 22 acts to maintain substances such as cereal 23 and milk 25 in each compartment 24, 26 separately, as shown in FIG. 3, until intermixture is desired. All material used for the membrane 22 may be continuous with a material employed as a lining for the cereal or milk compartment. Membrane 22 has a frangible portion which may be fabricated to rupture in one of several ways, as shown in FIGS. 6 through 14. In a preferred embodiment, as shown in FIG. 6, a cross-seam perforation 30 is formed in the membrane 22 at a location offset from the center of membrane 22. Additionally, a partial wall 34, which can be made of suitably coated cardboard, for example, may be positioned underneath and contiguous or adjacent to the membrane 22, as shown in FIG. 3, with an opening 36 in the wall 34 being positioned in alignment with the cross-seam 30. Once the membrane 22 has been ruptured, as shown in FIG. 4, this embodiment allows for simple consumption of the cereal and milk with the wall 34 preventing regurgitation of cereal and milk back into upper compartment 24.

Other configurations of frangible membrane 22 include: a randomly rupturable membrane 40 (FIG. 10), a membrane with a rupturable center seam 42 (FIG. 11), a membrane with a rupturable offset seam 44 (FIG. 12), and a membrane with a rupturable cross-seam 46 (FIG. 13).

Figure 14:
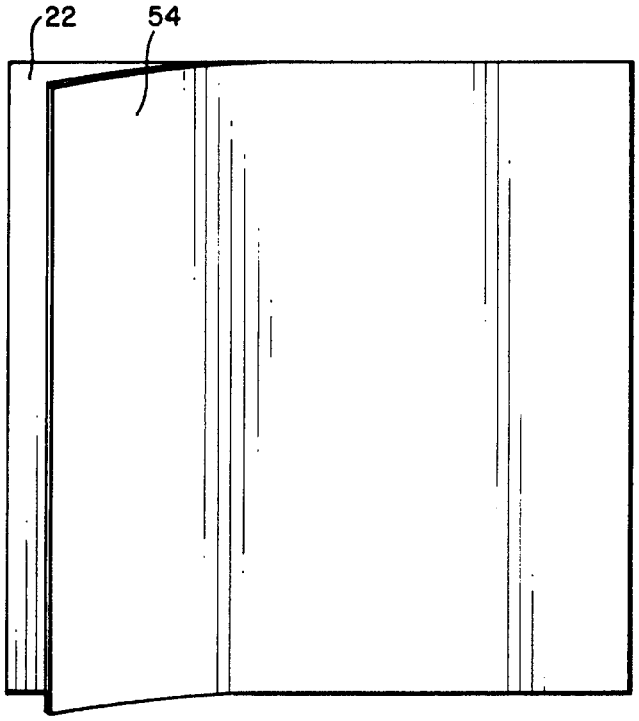
Figure 15:
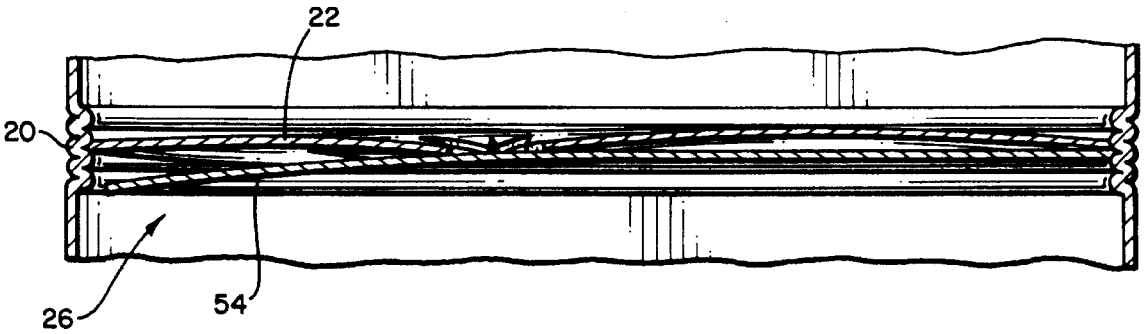
FIG. 15 is a fragmentary side view of the embodiment of FIG. 14 showing the partially opening wall during rupture of the membrane.

Other configurations of membrane 22 in conjunction with a partial wall 34 include: a membrane with a rupturable center seam 48 (FIG. 7), a membrane with a rupturable offset seam 50 (FIG. 8), and a membrane with a rupturable cross-seam 52 (FIG. 9). Additionally, as shown in FIG. 14, a resilient flap member 54 may be employed instead of partial wall 34 and may be placed under membrane 22 with the membrane 22 having either a random (FIG. 10) or a seam (FIGS. 11 through 13) rupture. The resilient flap member 54 may also be used in combination with the partial wall configuration of FIGS. 6 through 9. Resilient flap member 54 can allow milk to enter the lower compartment 26 as shown in FIG. 15 and then flap back into position so as to prevent milk from regurgitating back into the upper compartment 24 during consumption.

Figure 16:
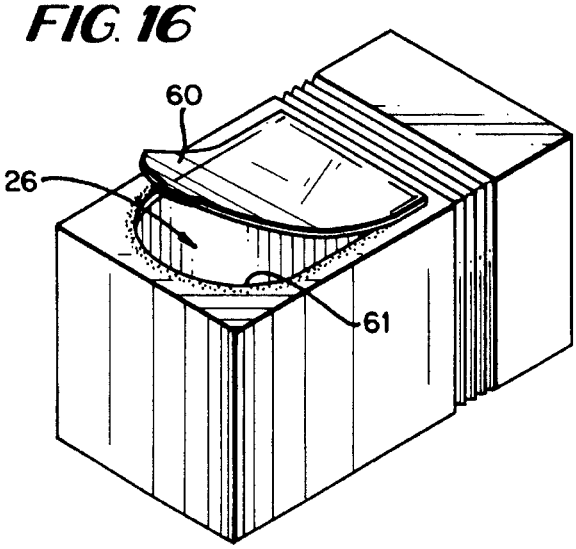
FIGS. 16 through 19 are perspective views of alternative embodiments of the lower compartment of the present invention.
Figure 17:
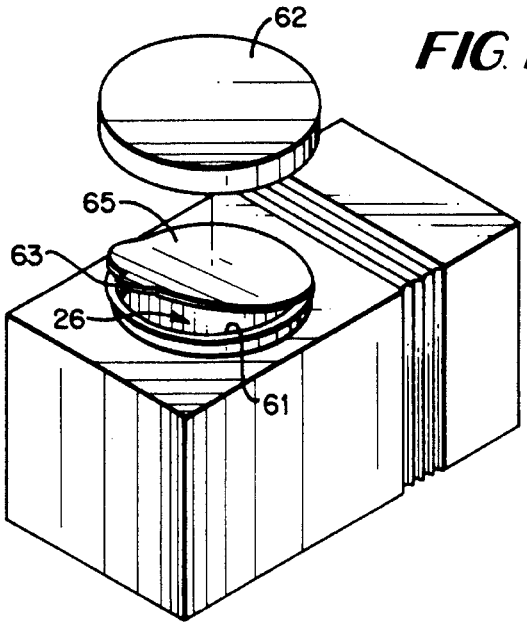
Figure 18:
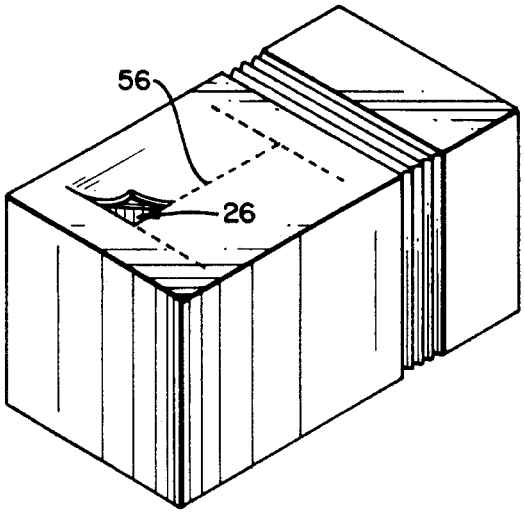
Figure 19:
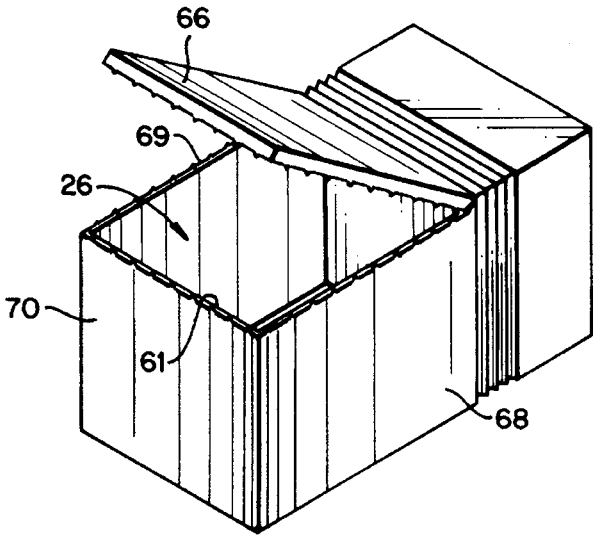

As shown in FIGS. 1 and 16 through 19, the lower compartment 26 of the cereal package 10 may be accessed in one of several ways. In a preferred embodiment, as shown in FIG. 16, a tongue-like flap 60 is secured by glue or the like around the edges of an existing access opening 61. Other configurations providing access to lower compartment 26 include the following: a cap 62 over a foil-covered access opening 61 wherein a tab 63 is provided for removing a foil covering 65 (FIG. 17); a perforated cross-seam 56 (FIG. 18); a tongue-like perforated seam 64 (FIG. 1); and a lid 66 having perforated edge surfaces which extend around the side walls 68, 69 and outer end wall 70 of the entire lower compartment 26 (FIG. 19).

Figure 5:
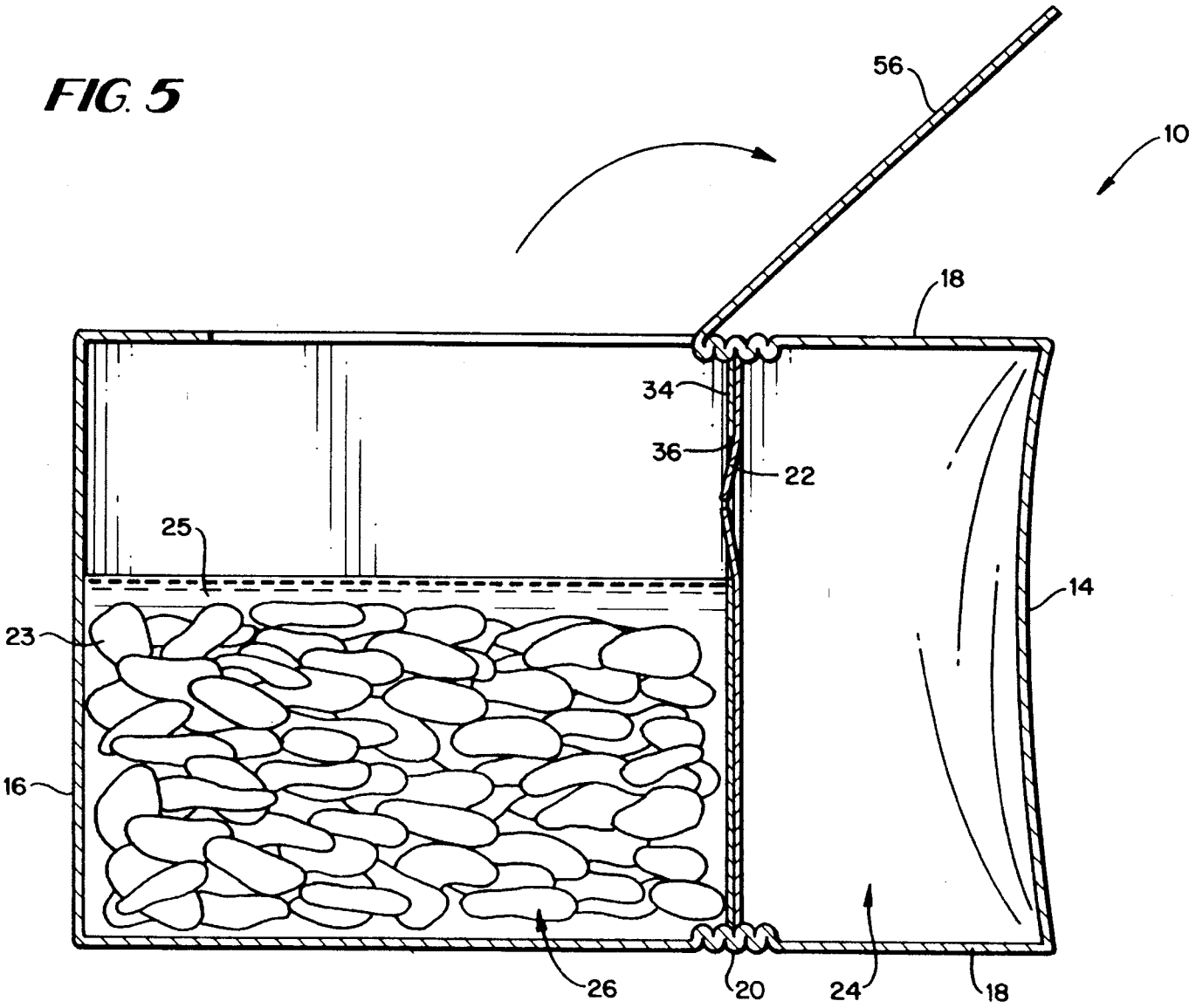
FIG. 5 is a side view of the cereal package of FIG. 1 turned on its back in ready-to-eat condition after rupture of the membrane and opening of the lower compartment.

In operation, when the user desires to mix the cereal 23 and milk 25, for example, hand pressure is applied to the top member 14 of the cereal package 10 so as to cause the corrugated ribs 20 of each side member 18 to collapse, as shown in FIG. 4, thus compacting the cereal package 10. As this happens, milk 25 in the upper compartment 24 becomes compressed and exerts pressure outwardly, causing membrane 22 to rupture and thereby allow mixture of the cereal 23 and milk 25. When package 10 is then turned on its back, as shown in FIG. 5, lower compartment 26 may be opened to provide the user with sufficient access for consumption of the contents.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed and desired to be secured by Letters Patent is:

1. A packaging assembly for milk and cereal that are to be intermixed, comprising:

a container having a side wall portion and an impervious frangible membrane extending across the width of said container to define an upper and a lower compartment within said container, said upper compartment containing a liquid in the form of milk to be intermixed with a solid in the form of cereal in said lower compartment, said lower compartment having an access aperture located along said side wall portion which is initially sealed and capable of being opened to provide access to the interior of said lower compartment to allow consumption of said milk and cereal, said side wall portion having a compressible portion which is deformed upon application of pressure to the upper end of said upper compartment so that said milk in said upper compartment exerts downward pressure to rupture said frangible membrane through the action of the pressurized milk alone.

2. The packaging assembly of claim 1 wherein said compressible side wall portion is in the form of corrugated ribs.

3. The packaging assembly of claim 1 wherein said milk has been subjected to UHT conditions to allow said milk to be stored unrefrigerated for long periods of time.

* * * * *